US011431113B2

(12) United States Patent
Herrmann et al.

(10) Patent No.: US 11,431,113 B2
(45) Date of Patent: Aug. 30, 2022

(54) CRIMP CONNECTION AND CRIMP METHOD FOR A CRIMP ASSEMBLY WITH AT LEAST ONE RETENTION SHOULDER

(71) Applicant: TE Connectivity Germany GmbH, Bensheim (DE)

(72) Inventors: Andreas Herrmann, Bensheim (DE); Daniel Bischoff, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/952,624

(22) Filed: Nov. 19, 2020

(65) Prior Publication Data

US 2021/0159615 A1 May 27, 2021

(30) Foreign Application Priority Data

Nov. 21, 2019 (EP) ..... 19210715

(51) Int. Cl.

| | |
|---|---|
| ***H01R 4/20*** | (2006.01) |
| ***H01R 4/18*** | (2006.01) |
| ***H01R 9/05*** | (2006.01) |
| ***H01R 43/20*** | (2006.01) |

(52) U.S. Cl.

CPC ..... *H01R 4/20* (2013.01); *H01R 4/183* (2013.01); *H01R 9/0518* (2013.01); *H01R 43/20* (2013.01)

(58) Field of Classification Search

CPC . H01R 4/183; H01R 4/18; H01R 4/14; H01R 4/10; H01R 9/0518; H01R 9/05; H01R 9/03; H01R 43/20; H01R 4/20

USPC ..... 439/877–885

See application file for complete search history.

(56) References Cited

U.S. PATENT DOCUMENTS

| | | | | |
|---|---|---|---|---|
| 4,046,451 | A * | 9/1977 | Juds | H01R 24/566 439/583 |
| 5,007,861 | A * | 4/1991 | Stirling | H01R 4/5033 439/578 |
| 5,499,934 | A * | 3/1996 | Jacobsen | H01R 9/0518 439/585 |
| 5,993,254 | A * | 11/1999 | Pitschi | H01R 9/0521 439/584 |
| 6,261,126 | B1 * | 7/2001 | Stirling | H01R 9/0521 439/583 |
| 6,331,123 | B1 * | 12/2001 | Rodrigues | H01R 13/5202 439/584 |
| 6,955,562 | B1 * | 10/2005 | Henningsen | H01R 9/0521 439/578 |

(Continued)

FOREIGN PATENT DOCUMENTS

WO 2017191527 11/2017

OTHER PUBLICATIONS

Extended European Search Report, European Application No. 19210715.9-1201, European Filing Date, dated Apr. 23, 2020.

*Primary Examiner* — Harshad G Patel
(74) *Attorney, Agent, or Firm* — Barley Snyder

(57) ABSTRACT

A crimp assembly for electrically contacting a conductive component of an electrical cable includes an anvil bushing and a compression sleeve. The anvil bushing has a retention shoulder extending circumferentially on an outer peripheral surface of the anvil bushing and supporting a section of the conductive component. The compression sleeve has an inner diameter larger than an outer diameter of the retention shoulder.

17 Claims, 7 Drawing Sheets

(56) References Cited

U.S. PATENT DOCUMENTS 6,976,872 B1 * 12/2005 Wild ..... H01R 13/5205 439/274
7,077,700 B2 * 7/2006 Henningsen ..... H01R 9/0521 439/583
7,458,851 B2 * 12/2008 Montena ..... H01R 9/0521 439/584
7,513,795 B1 * 4/2009 Shaw ..... H01R 9/0521 439/578
7,588,460 B2 * 9/2009 Malloy ..... H01R 13/5202 439/578
7,841,896 B2 * 11/2010 Shaw ..... H01R 9/0521 439/578
7,931,498 B2 * 4/2011 Skeels ..... H01R 9/0524 439/578
7,942,695 B1 * 5/2011 Lu ..... H01R 9/0524 439/578
7,979,339 B2 * 7/2011 Claus ..... G06Q 20/40 705/37
7,997,929 B2 * 8/2011 Montena ..... H01R 24/58 439/578
8,419,469 B2 * 4/2013 Montena ..... H01R 24/58 439/578
8,430,688 B2 * 4/2013 Montena ..... H01R 24/564 439/578
8,435,073 B2 * 5/2013 Wild ..... H01R 9/0521 439/578
8,439,703 B2 * 5/2013 Natoli ..... H01R 24/564 439/578
8,449,325 B2 * 5/2013 Wild ..... H01R 24/564 439/578
8,545,263 B2 * 10/2013 Islam ..... H01R 9/0521 439/578
11,075,491 B2 * 7/2021 Hsu ..... H01R 13/62
2004/0142596 A1 * 7/2004 Henningsen ..... H01R 9/0521 439/584
2005/0255735 A1 * 11/2005 Ward ..... H01R 13/506 439/352
2007/0015406 A1 * 1/2007 Chawgo ..... H01R 13/5205 439/578
2007/0155233 A1 * 7/2007 Laerke ..... H01R 13/025 439/578
2008/0003873 A1 * 1/2008 Henningsen ..... H01R 13/025 439/578
2008/0214049 A1 9/2008 Gump et al.
2010/0093211 A1 * 4/2010 Sutter ..... H01R 9/0521 439/578
2011/0086543 A1 * 4/2011 Alrutz ..... H01R 9/0524 439/578
2011/0230089 A1 * 9/2011 Amidon ..... H01R 13/6593 439/578
2013/0203287 A1 * 8/2013 Natoli ..... H01R 43/00 439/578
2014/0011397 A1 * 1/2014 Sutter ..... H01R 9/0524 439/578
2014/0134873 A1 5/2014 Lehmann

* cited by examiner

CRIMP CONNECTION AND CRIMP METHOD FOR A CRIMP ASSEMBLY WITH AT LEAST ONE RETENTION SHOULDER

CROSS-REFERENCE TO RELATED APPLICATION

This application claims the benefit of the filing date under 35 U.S.C. § 119(a)-(d) of European Patent Application No. 19210715.9, filed on Nov. 21, 2019.

FIELD OF THE INVENTION

The present invention relates to a crimp assembly and, more particularly, to a crimp assembly for electrically contacting a conductive component of an electrical cable, such as a screen or shield of a shielded electrical cable.

BACKGROUND

In the field of electrical engineering, cables for conducting electrical currents or signals may be surrounded by an electrically conductive shielding device. Depending on the respective application, the shielding device may serve to contain electro-magnetic radiation, which is generated within the cable, and thus protect nearby electrically sensitive components (e.g. control electronics or electronic measuring equipment). The shielding device may also provide protection for the cable itself and thus prevent electromagnetic interference (EMI) from negatively influencing signals transmitted via the cable.

In shielded electrical cables where a high-voltage power transmission, especially of up to 1000 V AC, is conducted, the resulting induction current induced within the shielding device surrounding the shielded electrical cable may amount to 30% of the main current. This induction current needs to be removed from the shielding device in order to maintain the functionality of the shielded electrical cable. Furthermore, the shielded electrical cable may be subjected to external mechanical influences, which also bear a risk of impairing the functionality of the shielded electrical cable.

SUMMARY

A crimp assembly for electrically contacting a conductive component of an electrical cable includes an anvil bushing and a compression sleeve. The anvil bushing has a retention shoulder extending circumferentially on an outer peripheral surface of the anvil bushing and supporting a section of the conductive component. The compression sleeve has an inner diameter larger than an outer diameter of the retention shoulder.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
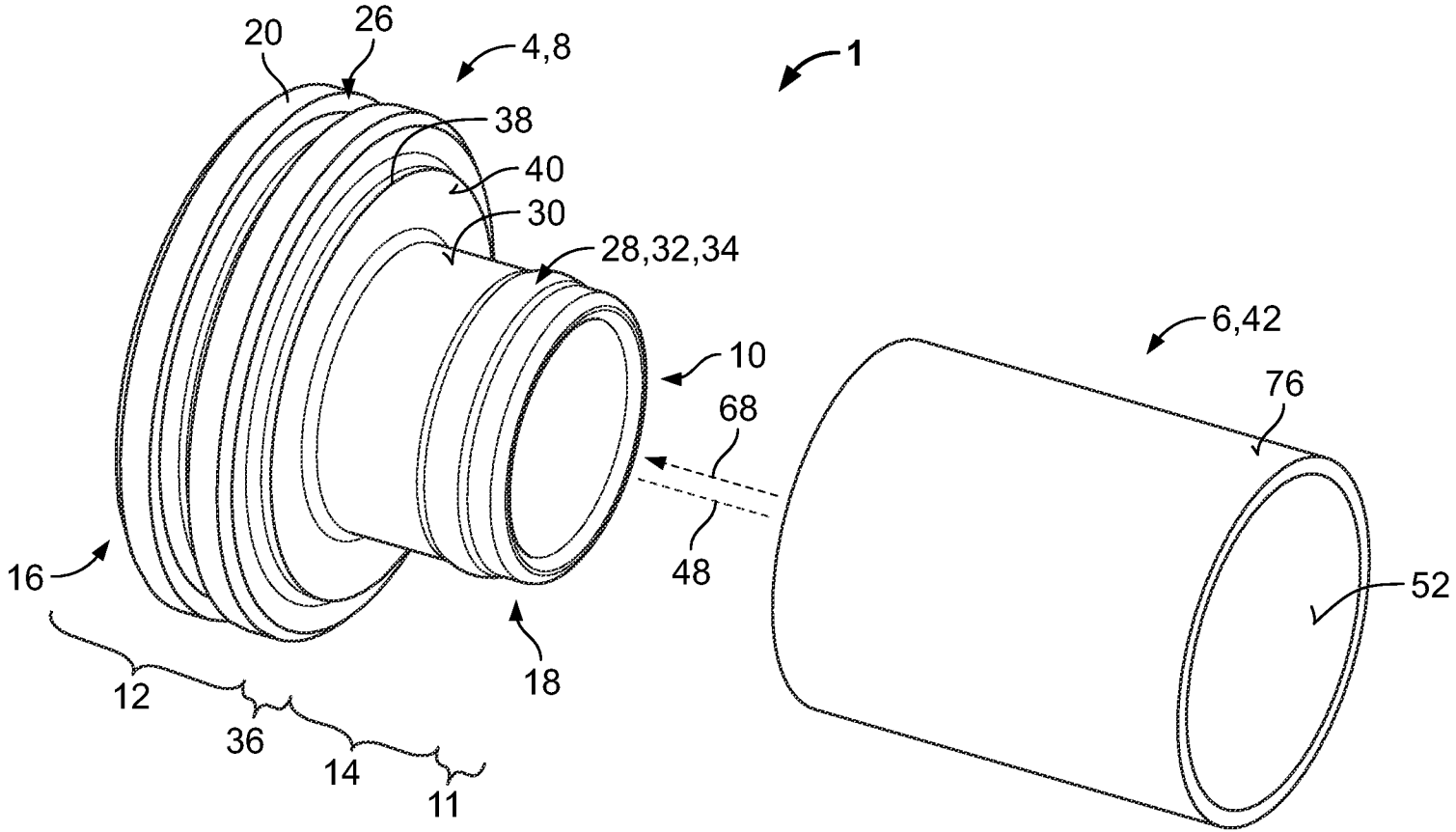
FIG. 1 is a perspective view of a crimp assembly according to an embodiment.

In the following, exemplary embodiments of the invention are described with reference to the drawings. The shown and described embodiments are for explanatory purposes only. The combination of features shown in the embodiments may be changed. For example, a feature which is not shown in an embodiment but described may be added if the technical effect associated with this feature is beneficial for a particular application. Vice versa, a feature shown as part of an embodiment may be omitted if the technical effect associated with this feature is not needed in a particular application. In the drawings, elements that correspond to each other with respect to function and/or structure have been provided with the same reference numeral.

Figure 5:
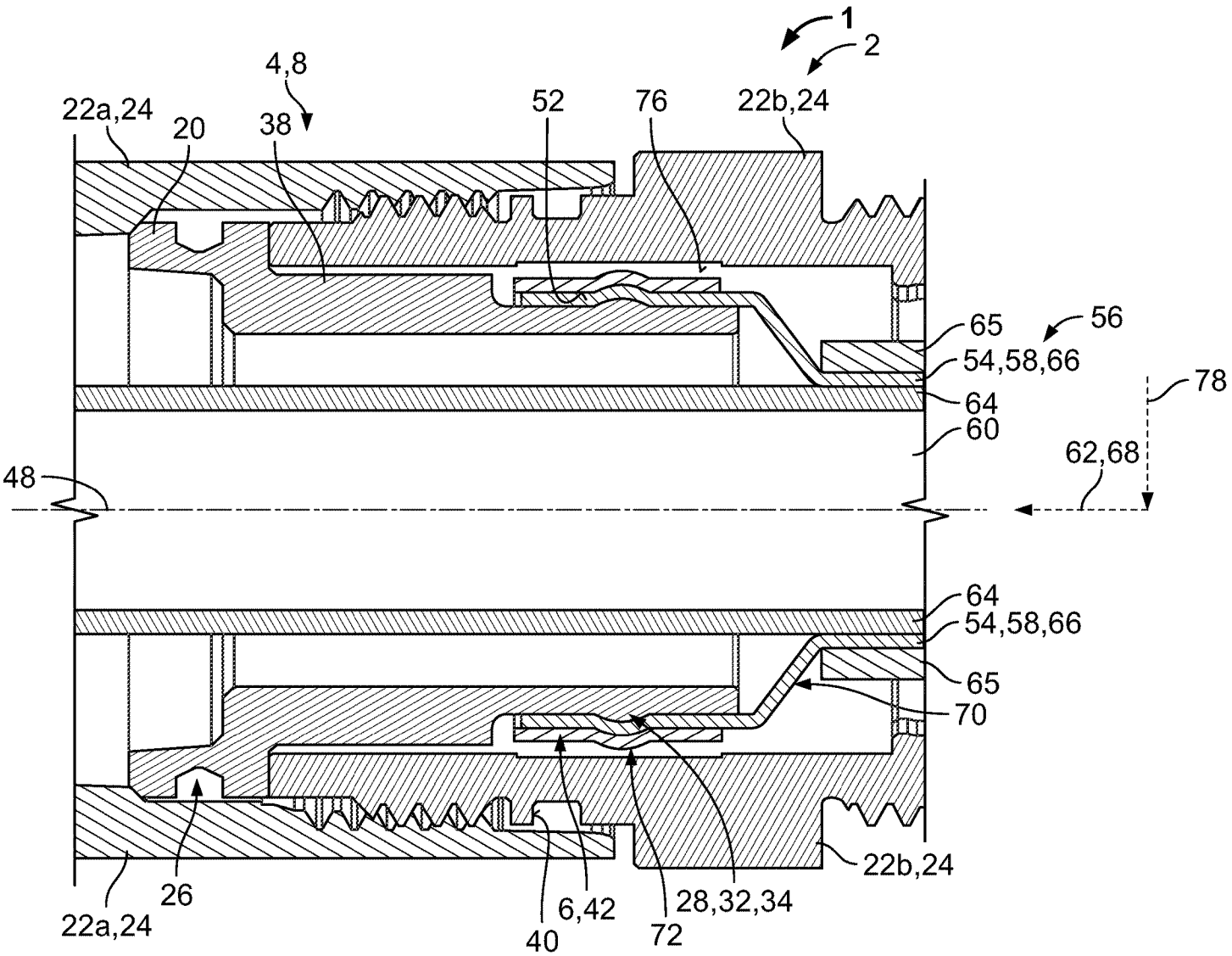
FIG. 5 is a sectional side view of a crimp connection according to an embodiment and a housing.
Figure 6:
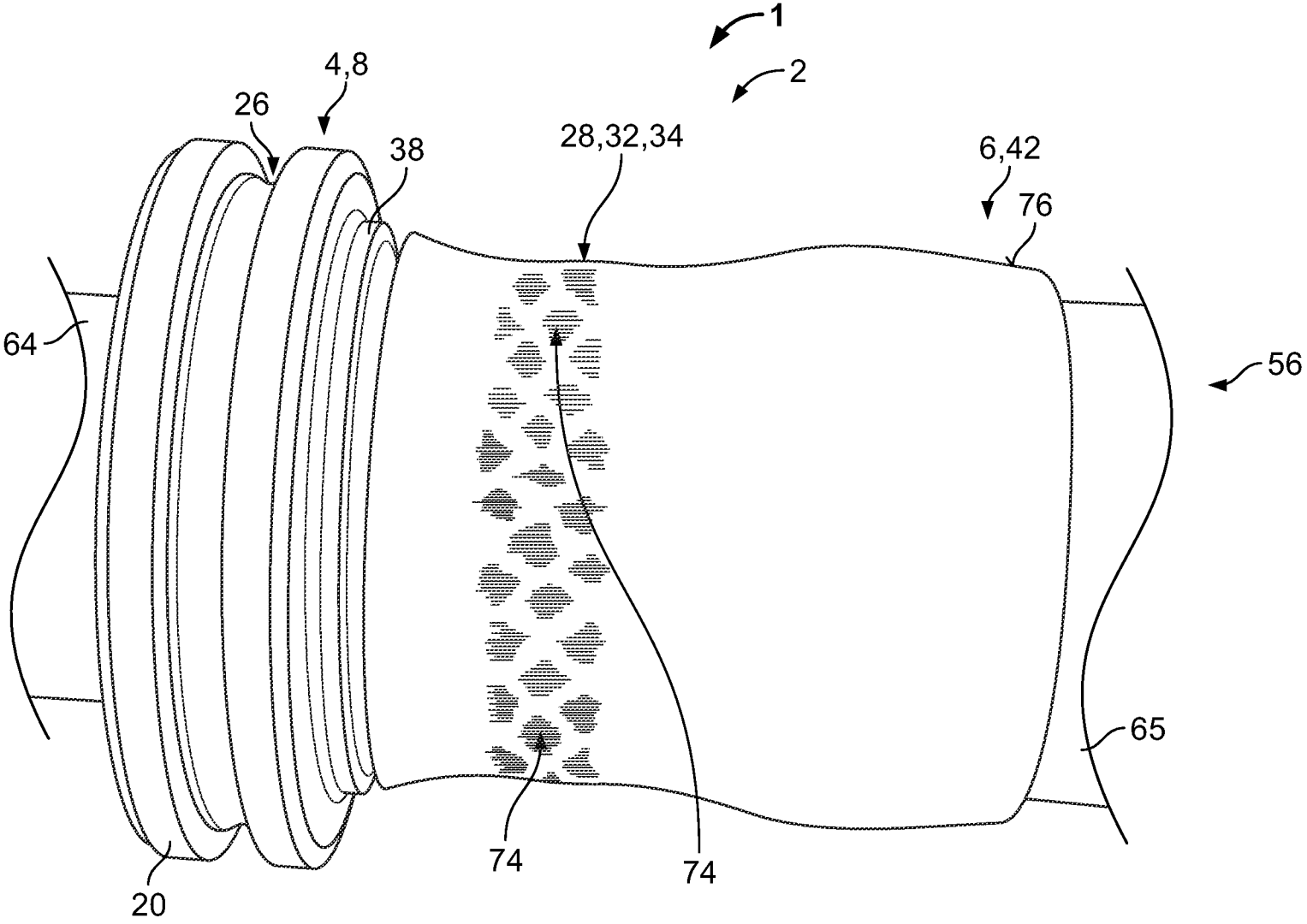
FIG. 6 is a perspective view of the crimp connection without the housing.
Figure 7:
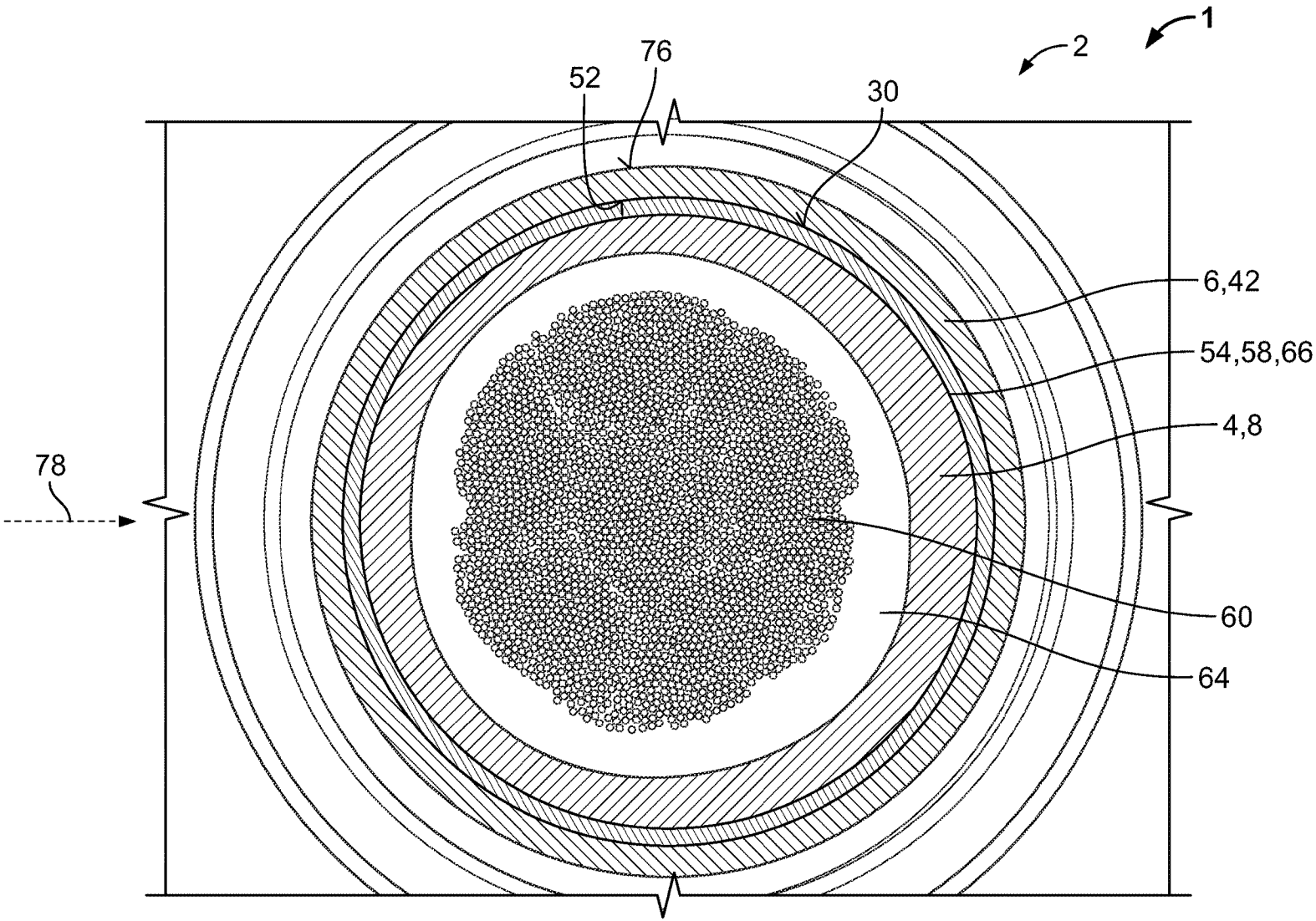
FIG. 7 is a sectional end view of the crimp connection without the housing.

First, the structure of a crimp assembly 1 according to the present invention is explained with reference to the exemplary embodiments shown in FIGS. 1-4. Further below, FIGS. 5-7 are used for explaining the structure of a crimp connection 2 according to the present invention.

Figure 2:
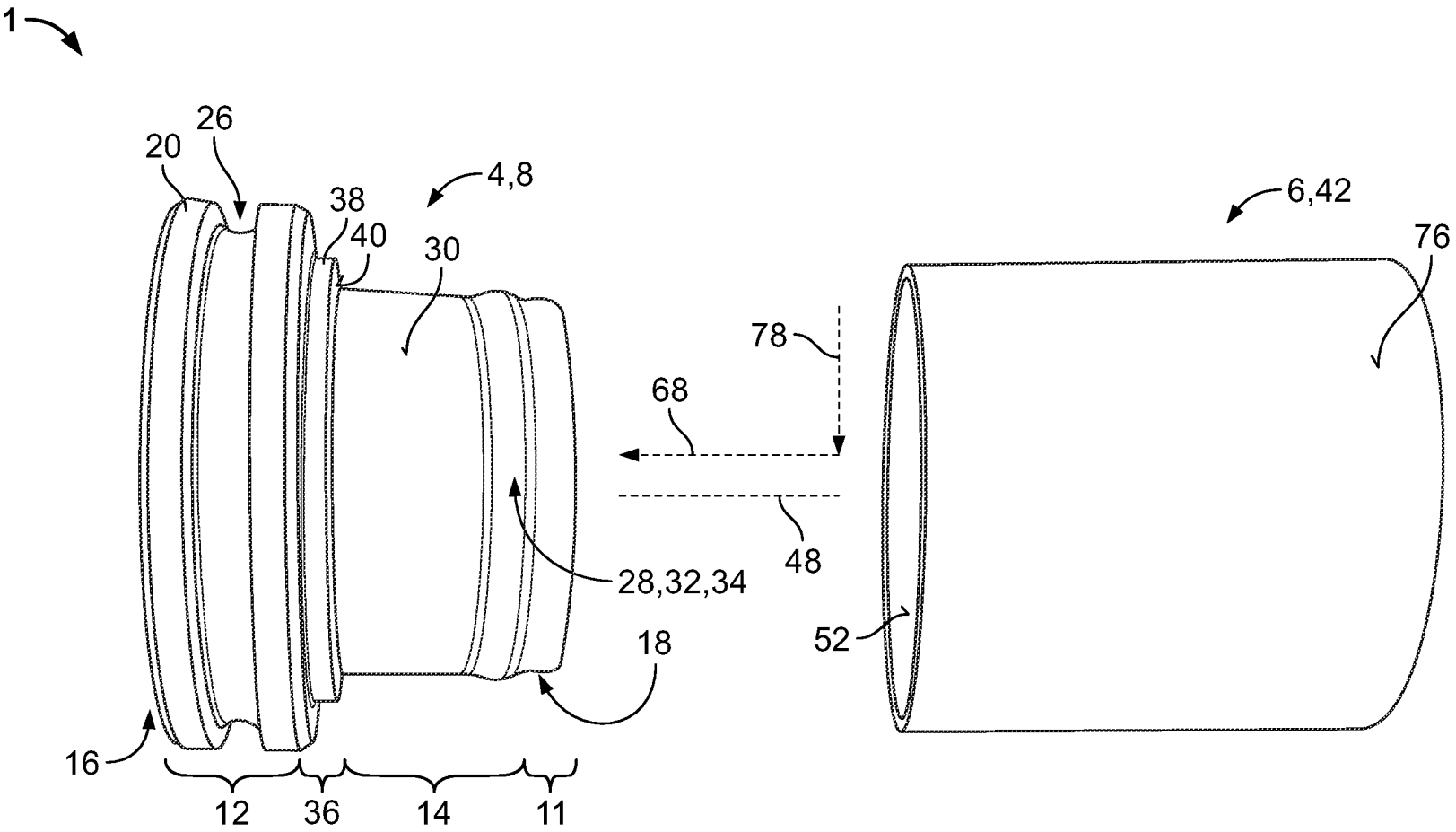
FIG. 2 is a side view of the crimp assembly.
Figure 3:
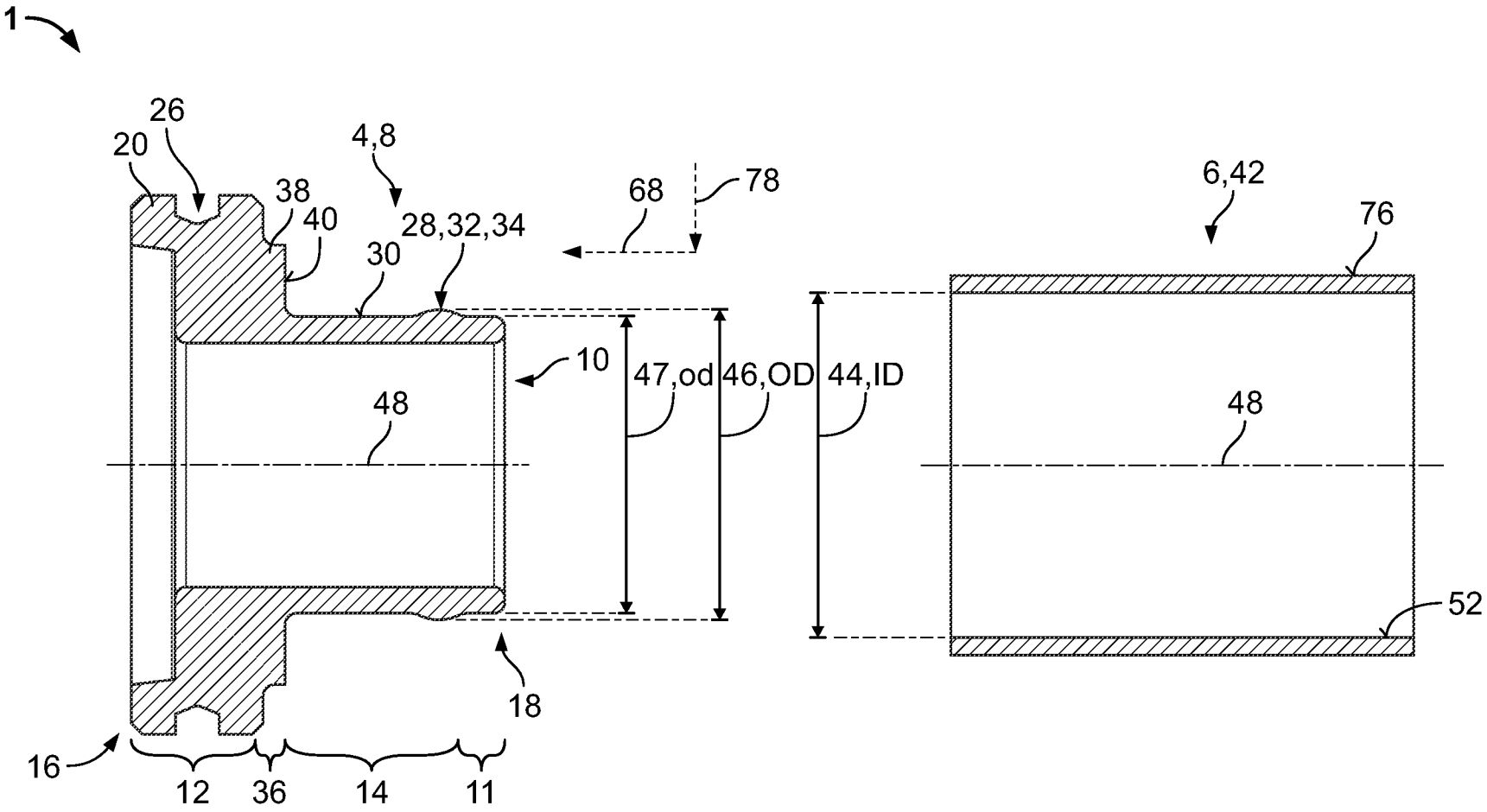
FIG. 3 is a sectional side view of the crimp assembly.

A crimp assembly 1 according to an embodiment, as shown in FIGS. 1-3, includes an anvil bushing 4 and a compression sleeve 6.

The anvil bushing 4, as shown in FIGS. 1-3, may be shaped as a hollow cylinder 8 with a lead-through opening 10, which extends along the rotational axis of the hollow cylinder 8. In the shown embodiment, the anvil bushing 4 has a flange section 12 at a first end 16, an end section 11 at a second end 18 opposite the first end 16, and a crimping section 14 between the flange section 12 and the end section 11. The anvil bushing 4 may be a turned, cold-formed, or deep-drawn part made of an electrically conductive material.

At the flange section 12, a radial flange 20 may protrude radially outwards, as shown in FIGS. 1-3. As can be seen in FIG. 5, the radial flange 20 may serve as support for holding the anvil bushing 4 between two halves 22*a*, 22*b* of a housing 24 surrounding the crimp assembly 1. The radial flange 20 has a circumferential slot 26 for insertion of a coil spring (not shown) in order to establish an electrical connection between the anvil bushing 4 and the housing 24.

In the crimping section 14, at least one retention shoulder 28 may be formed on an outer circumferential surface 30 of the anvil bushing 4, as shown in FIGS. 1-3. The at least one retention shoulder 28 of the shown exemplary embodiment may be formed by at least one radially outwardly protruding projection 32, which continuously extends along the circumference of the anvil bushing 4. More particularly, the at least one retention shoulder 28 may be at least one bulge-like rim 34 extending continuously along the circumference of the anvil bushing 4.

In another embodiment, the at least one retention shoulder 28 may extend discontinuously along the circumference of the anvil bushing 4. More particularly, the at least one retention shoulder 28 may extend intermittently along at least one section of the outer circumferential surface 30 of the anvil bushing 4, e.g. in the shape of symmetrically arranged dome-like nobs (not shown). In the embodiment with a discontinuously extending retention shoulder 28, the at least one retention shoulder 28 may create a symmetric pattern along the circumferential direction of the anvil bushing 4. This embodiment is favorable for a cold-formed or deep-drawn anvil bushing 4, as no rotational symmetry is required. Additionally, in case of discontinuous retention shoulders 28, the individual retention shoulders 28 may be mutually offset about a predefined angle with respect to one another in the circumferential direction.

According to yet another embodiment, a plurality of retention shoulders 28 may be formed on the anvil bushing 4. The individual retention shoulders 28 may be mutually spaced apart, e.g. by being mutually offset in the axial direction of the anvil bushing 4.

In another embodiment, the retention shoulder 28 may be formed by at least one radially inwardly recessing groove (not shown) extending along the circumference of the anvil bushing 4 continuously or discontinuously.

In the sectional view of FIG. 3, the at least one retention shoulder 28 in the form of the at least one bulge-like rim 34 is shown with a round profile. Alternatively, the at least one retention shoulder 28 may have one of a semi-circular, square, trapezoidal or prismatic profile.

Figure 4:
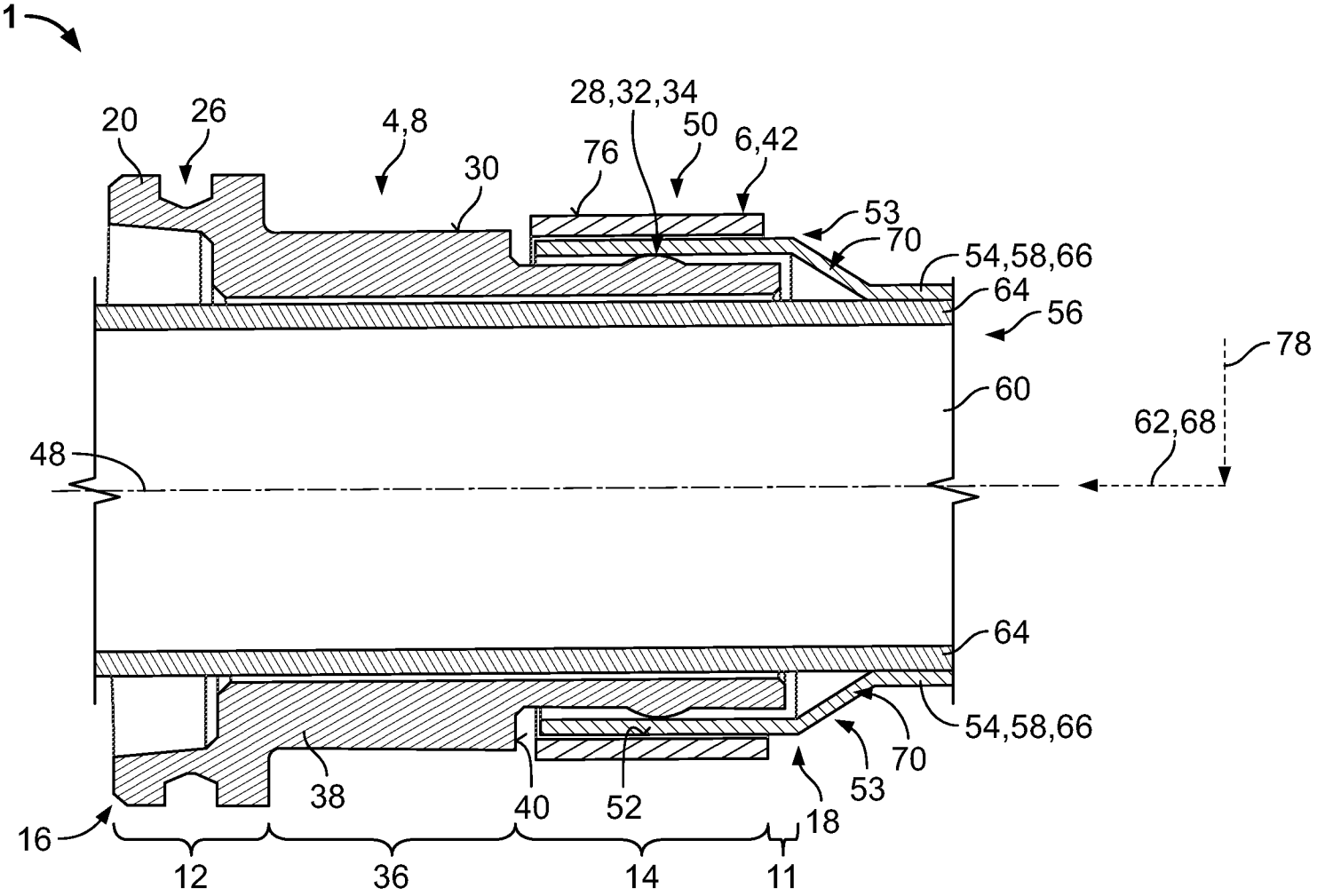
FIG. 4 is a sectional side view of the crimp assembly with a shielded electrical cable.

Optionally, as shown in FIGS. 2, 3 and 4, a spacing section 36 may be formed monolithically between the crimping section 14 and the flange section 12 of the anvil bushing 4. The spacing section 36 may comprise a step 38, wherein at least one end face 40 of the step 38 may serve as an end stop for the compression sleeve 6 to abut against.

As shown in FIG. 3, the compression sleeve 6 may be a thin-walled cylinder 42 made of an electrically conductive material with a constant inner diameter ID, 44. The inner diameter ID, 44 of the compression sleeve 6 is larger than an outer diameter OD, 46 of the retention shoulder 28. In the shown exemplary embodiment, the outer diameter OD, 46 of the retention shoulder 28 is larger than the outer diameter od, 47 of the end section 11. In another embodiment, the outer diameter OD, 46 of the retention shoulder 28 may be smaller than the outer diameter od, 47 of the end section 11. In another embodiment, a step-like or gradual transition may connect the retention shoulder 28 with the end section 11. If more than one retention shoulder 28 is formed on the anvil bushing 4, the outer diameters 46, OD of the retention shoulders 28 may be larger than the outer diameter of a section of the anvil bushing 4 between the retention shoulders 28.

As can be seen from FIGS. 4 and 5, the compression sleeve 6 may be positioned coaxially with respect to the anvil bushing 4. More particularly, the compression sleeve 6 and the anvil bushing 4 may be aligned along a common center axis 48. In an embodiment, the compression sleeve 6 may be sleeved over the anvil bushing 4 at least to a position 50, where the compression sleeve 6 overlaps partially with the crimping section 14 of the anvil bushing 4. In the position 50, the retention shoulder 28 of the anvil bushing 4 faces the direction of the inner surface 52 of the compression sleeve 6.

The inner diameter ID, 44 of the compression sleeve 6, in an embodiment, is configured such that the inner surface 52 of the compression sleeve 6 is at least spaced apart from a conductive component 54 of a shielded electrical cable 56 in a state where the conductive component 54 is contacted with or at least sleeved over the outer circumferential surface 30 of the anvil bushing 4 and the compression sleeve 6 is in the position 50. In particular, the compression sleeve 6 may be adapted to receive the anvil bushing 4 forming an annular gap 53 of constant width at at least one axial position. This is further shown in FIG. 4.

In the shown exemplary embodiment of FIG. 4, the conductive component 54 may be a cable shield 58 of the shielded electrical cable 56. More particularly, the shielded electrical cable 56 may comprise a main conductor 60 extending along an axial direction 62 of the shielded electrical cable 56, a first inner cable insulation layer 64 surrounding the main conductor 60, a shield braid 66 functioning as the cable shield 58 and surrounding the first inner cable insulation layer 64, and a second outer cable insulation layer 65 surrounding the shield braid 66. The shield braid 66 may be woven from a metal wire. In other embodiments, the conductive component 54 may be any conductive part of a cable that includes a plurality of wire strands, such as the shield braid 66 or a conductor including several wires.

The shield braid 66 may at least partially be widened and sleeved over the crimping section 14 of the anvil bushing 4 in a sleeving direction 68. In an embodiment, a widened section 70 of the shield braid 66 may be at least sleeved over the retention shoulder 28 of the anvil bushing 4. The main conductor 60 and the first inner cable insulation layer 64, may be inserted through the lead-through opening 10 of the anvil bushing 4. The second outer cable insulation layer 65 may be terminated or cut off at a widened section 70 of the shield braid 66.

FIG. 4 shows a crimp assembly 1 ready to be deformed in order to create a crimp connection 2 according to the present invention. More particularly, the compression sleeve 6 may be compressed around the anvil bushing 4 by contactless crimping, for example by crimping through electromagnetic pulse technology (EMPT crimping) or explosive crimping. Alternatively, the compression sleeve 6 may be compressed around the anvil bushing 4 by mechanical crimping, e.g. hexagonal crimping. In the case of a mechanically crimped crimp connection 2, the crimping tool used for the mechanical crimping may comprise a crimp mold with an inner contour formed complementary to the outer cubage of the anvil bushing 4.

In embodiments of the crimp connection 2, where the compression sleeve 6 is compressed by EMPT crimping, the anvil bushing 4 and the compression sleeve 6 may be made of the same material or a pair of different materials. In particular, the anvil bushing 4 may be made of any electrically conductive material, as long as the combination of material strength and material thickness prevents the anvil bushing 4 from being deformed by the EMPT crimping. The compression sleeve 6 may be made of any electrically conductive material, as long as the combination of material strength, material ductility and material thickness allows the compression sleeve 6 to be plastically deformed by the EMPT crimping.

FIG. 5 shows a sectional view of an exemplary embodiment of a crimp connection 2 comprising a crimp assembly 1 according to the present invention. As can be seen, the compression sleeve 6 is compressed around the anvil bushing 4 and the shield braid 66 is sandwiched between the anvil bushing 4 and the compression sleeve 6. Thus, the anvil bushing 4 is electrically contacted to the shield braid 66 of the shielded electrical cable 56. Further, the retention shoulder 28 mechanically bears the shield braid 66 and the compression sleeve 6 due to a resulting form-fit 72, which may be a wave-like form fit 72. The compression sleeve 6 presses, or directly presses, the conductive component 54 against the retention shoulder 28 to establish reliable electrical contact. Thus, when a pull-out force along an axial direction 62 of the electrical cable 56 is exerted on the conductive component 54, a counterforce occurs at the retention shoulder 28 with at least a force component directed in the axial direction 62 and against the pull-out force. Therefore, the resistance against external mechanical influences is improved for the inventive crimp assembly compared to a crimp assembly with a shoulder-less anvil bushing.

As can be seen in the side view of the crimp connection 2 of FIG. 6, at least a part of the surface structure 74 of the retention shoulder 28 is pressed through on an outer surface 76 of the compression sleeve 6. For this, the anvil bushing 4 is constructed more rigidly than the compression sleeve 6 at least in a radial direction 78. Thus, it is ensured that the anvil bushing 4 maintains its functionality to mechanically support the conductive component 54 without deforming, while the compression sleeve 6 may be deformed in order to create a compression on the conductive component 54, which improves the electrical contact between the anvil bushing 4 and the conductive component 54.

The retention shoulder 28 exhibits at least two changes in the outer diameter of the anvil bushing 4 and thus allows for a bidirectional fixation of the conductive component 54 and/or the compression sleeve 6 mechanically bearing against the retention shoulder 28. In other words, the retention shoulder 28 may receive external forces exerted on the conductive component 54 and/or the compression sleeve 6, which are oriented in the sleeving direction 68 or against the sleeving direction 68. Thus, the mechanical stability at the area of contacting is further improved.

More particularly, the compression sleeve 6 is evenly shrunk in the radial direction 78 and visibly renders the shape of the anvil bushing 4, which is not deformed. In embodiments with compression sleeves deformed e.g. by EMPT crimping or high-precision mechanical crimping, the surface structure 74 of the shield braid 66 may also be pressed through on the outer surface 76 of the compression sleeve 6. During manufacturing of the crimp connection 2, this may serve as a visual indicator for a successfully crimped compression sleeve 6.

FIG. 7 shows a cross section of the crimp connection 2 perpendicular to the center axis 48. As can be seen, the anvil bushing 4 may be evenly contacted with the shield braid 66 along the entire circumference of the anvil bushing 4.

Next, a crimp method according to the present invention is described with reference to FIGS. 1-7. The crimp method comprises the step of providing a crimp assembly 1 as shown in FIGS. 1-3 and an electrical cable having a conductive component 54, such as a shielded electrical cable 56 having a shield braid 66. The conductive component 54 is arranged between a retention shoulder 28, which extends circumferentially on an outer surface, in an embodiment an outer circumferential surface 30, of an anvil bushing 4, and a compression sleeve 6. More particularly, the conductive component 54 is arranged between the retention shoulder 28 and an inner surface 52 of the compression sleeve 6. In case of the conductive component 54 being a shield braid 66, the shield braid 66 may be at least partially widened and sleeved over the retention shoulder 28 of the anvil bushing 4 as shown in FIG. 4. Subsequently, the compression sleeve 6 is compressed in a radially inward direction 78. Thereby, the conductive component 54 is clamped at least between the retention shoulder 28 and the compression sleeve 6. The resulting crimp connection 2 is shown in FIGS. 5-7.

The crimp assembly 1 may be brought into electrical contact with the conductive component 54, so as to divert or discharge an induction current induced in the conductive component 54, e.g. when an alternating electric current flows through the electrical cable 56.

The present invention provides a reliable way of electrically contacting a conductive component 54 of an electrical cable, such as a shield braid 66 of a shielded electrical cable 56, while offering high mechanical stability at the area of contacting, which can withstand external pull-out forces and vibrations.

What is claimed is:

1. A crimp assembly for electrically contacting a conductive component of an electrical cable, comprising:

an anvil bushing having a retention shoulder extending circumferentially on an outer peripheral surface of the anvil bushing and supporting a section of the conductive component; and a compression sleeve having an inner diameter larger than an outer diameter of the retention shoulder, the anvil bushing and the compression sleeve are each formed of an electrically conductive material and the anvil bushing is more rigid than the compression sleeve in a radial direction.

2. The crimp assembly of claim 1, wherein the compression sleeve receives the anvil bushing with an annular gap between the compression sleeve and the anvil bushing.

3. The crimp assembly of claim 2, wherein the annular gap has a constant width at an axial position along a center axis of the compression sleeve and the anvil bushing.

4. The crimp assembly of claim 1, wherein the outer diameter of the retention shoulder is larger than an outer diameter of an end section of the anvil bushing.

5. The crimp assembly of claim 1, wherein the retention shoulder is formed by a radially outwardly protruding rim that continuously or discontinuously extends along a circumference of the anvil bushing.

6. The crimp assembly of claim 1, wherein the retention shoulder is formed by a radially inwardly recessing groove that continuously or discontinuously extends along a circumference of the anvil bushing.

7. The crimp assembly of claim 1, wherein the anvil bushing has a plurality of retention shoulders.

8. The crimp assembly of claim 7, wherein the retention shoulders are discontinuous in a circumferential direction and mutually offset about a predefined angle with respect to one another in the circumferential direction.

9. A crimp connection, comprising:

a shielded electrical cable having a conductive component; and a crimp assembly including an anvil bushing having a retention shoulder extending circumferentially on an outer peripheral surface of the anvil bushing and supporting a section of the conductive component, and a compression sleeve having an inner diameter larger than an outer diameter of the retention shoulder, the anvil bushing and the compression sleeve are each formed of an electrically conductive material and the anvil bushing is more rigid than the compression sleeve in a radial direction, the conductive component is sandwiched between the anvil bushing and the compression sleeve.

10. The crimp connection of claim 9, wherein the anvil bushing and the compression sleeve are coaxially aligned along a common center axis.

11. The crimp connection of claim 10, wherein the anvil bushing evenly contacts the conductive component along an entire periphery of the anvil bushing in a cross-section of the crimp connection perpendicular to the common center axis.

12. The crimp connection of claim 9, wherein at least parts of the retention shoulder and/or the conductive component are at least partly visibly rendered on an outer surface of the compression sleeve.

13. The crimp connection of claim 9, wherein the compression sleeve is compressed around the anvil bushing by contactless crimping.

14. The crimp connection of claim 9, wherein the compression sleeve is compressed around the anvil bushing by mechanical crimping.

15. The crimp connection of claim 9, wherein a form-fit is formed between the compression sleeve and the retention shoulder.

16. A crimp method, comprising:

providing an electrical cable having a conductive component;

arranging the conductive component between a retention shoulder extending circumferentially an outer surface of an anvil bushing and a compression sleeve; and compressing the compression sleeve in a radially inward direction, clamping the conductive component between the retention shoulder and the compression sleeve, the anvil bushing and the compression sleeve are each formed of an electrically conductive material and the anvil bushing is more rigid than the compression sleeve in the radially inward direction.

17. A crimp assembly for electrically contacting a conductive component of an electrical cable, comprising:

an anvil bushing having a plurality of retention shoulders extending circumferentially on an outer peripheral surface of the anvil bushing and supporting a section of the conductive component, the retention shoulders are discontinuous in a circumferential direction and mutually offset about a predefined angle with respect to one another in the circumferential direction; and a compression sleeve having an inner diameter larger than an outer diameter of the retention shoulder.

* * * * *